United States Patent [19]

Thorn et al.

[11] 4,393,734

[45] Jul. 19, 1983

[54] COMBINED TORQUE LIMITING AND MARKING WRENCH

[75] Inventors: M. W. Thorn; E. R. Thorn, both of Farmington Hills; Brent Thorn, Northville, all of Mich.

[73] Assignee: Van F. Belknap Co., Inc., Wixom, Mich.

[21] Appl. No.: 267,836

[22] Filed: May 28, 1981

[51] Int. Cl.[3] ..... B25B 23/00

[52] U.S. Cl. ..... 81/468

[58] Field of Search ..... 81/468, 119, 177 A

[56] References Cited

U.S. PATENT DOCUMENTS

| | | | |
|---|---|---|---|
| 956,197 | 4/1910 | Semsmon | 81/177 A |
| 1,088,786 | 3/1914 | Lukowski | 81/177 A |
| 1,256,216 | 2/1918 | Fessler | 81/177 A |
| 3,523,471 | 8/1970 | Lance | 81/468 |
| 3,802,301 | 4/1974 | Peterson | 81/468 |

FOREIGN PATENT DOCUMENTS

| | | | |
|---|---|---|---|
| 8003 | 10/1907 | France | 81/177 A |

*Primary Examiner*—James L. Jones, Jr.

*Attorney, Agent, or Firm*—Cullen, Sloman, Cantor, Grauer, Scott & Rutherford

[57] ABSTRACT

A torque limiting wrench which has a marking mechanism to mark a part that is tightened by the wrench at the instant the intended torque has been applied to the part. The wrench includes an elongated torque applying handle, a cylindrical housing mounted at one end to the torque applying handle, a replaceable part engaging head assembly releasably mounted to the other end of the cylindrical housing, and a part marking mechanism mounted within the cylindrical housing. An on-off valve unit, associated with the torque applying handle, is actuated in response to the desired torque level being reached to operate the marking mechanism by which a mark is applied to the part simultaneously with the interruption of torque transmission. The head assembly is releasably retained to one end of the cylindrical housing such that an operator may simply and conveniently replace any head assembly with another one of a different size or design. Further, the cylindrical housing, which houses the marking mechanism, is positionable at various attitudes relative to the torque applying handle depending upon the location of the part and the available work space.

2 Claims, 8 Drawing Figures

FIG. 3
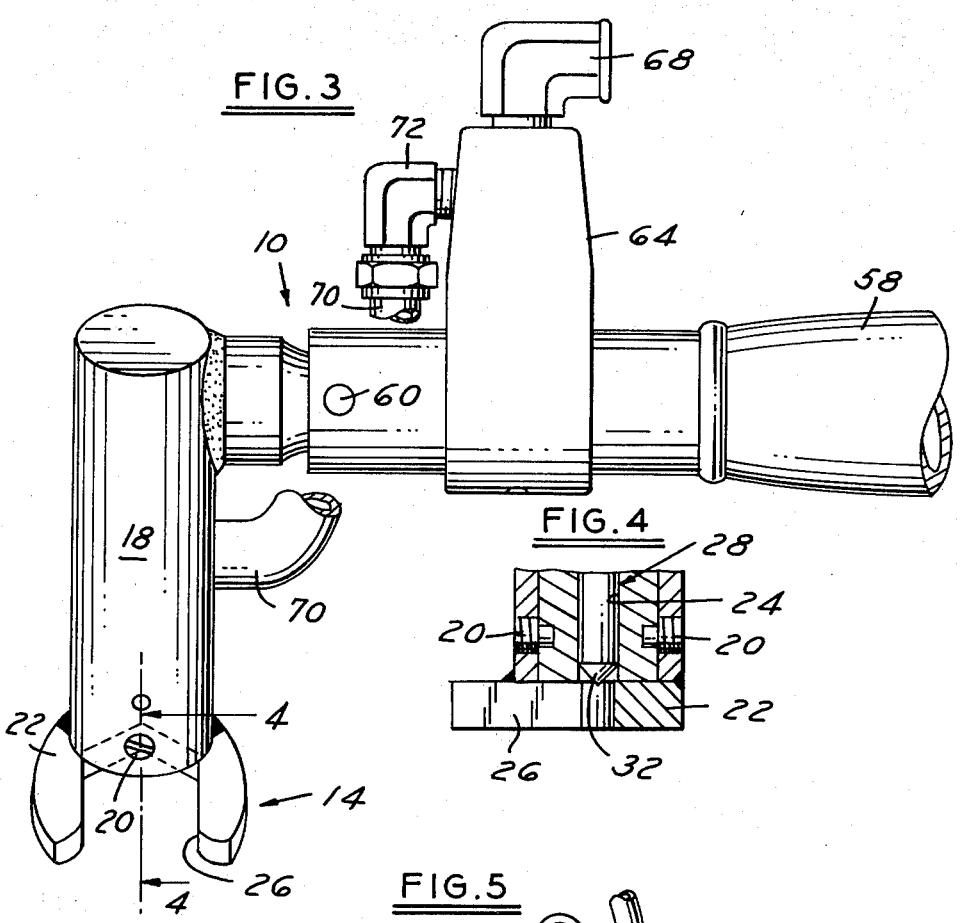
FIG. 4
FIG. 5
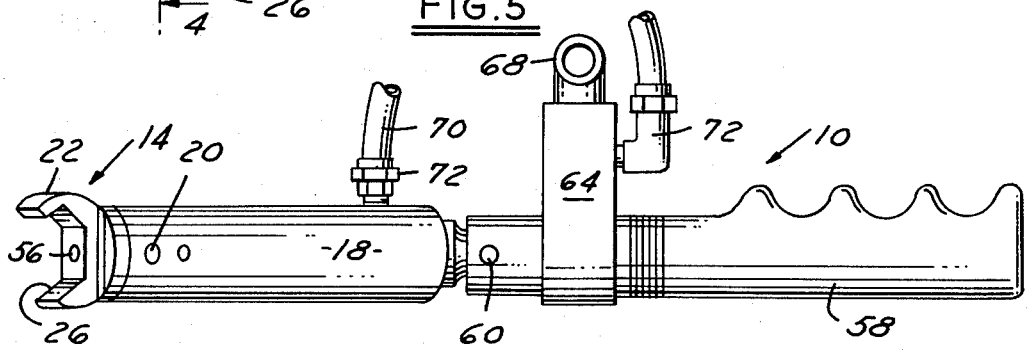
FIG. 6
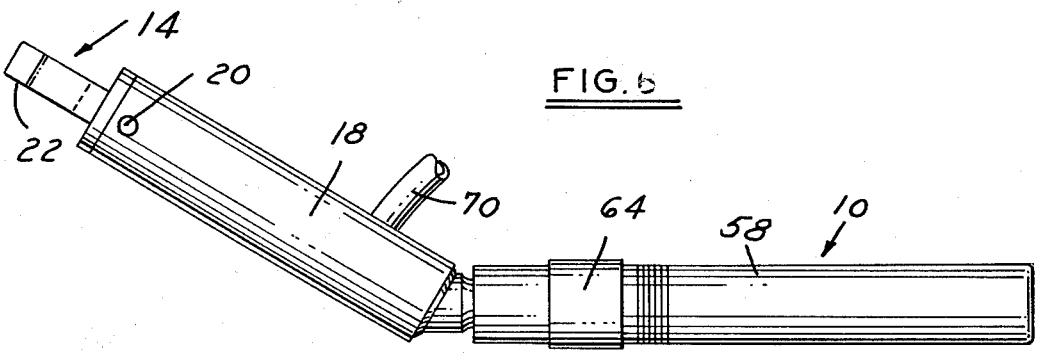

COMBINED TORQUE LIMITING AND MARKING WRENCH

BACKGROUND OF THE INVENTION

The present invention relates to a precision type torque limiting wrench which has a marking mechanism to mark a part that is tightened by the wrench at the instant the intended torque has been applied to the part.

A torque limiting wrench has application in various environments, including automotive, aircraft, and related production lines, where it is desired to apply an equal torque value to each of a number of parts or fasteners. In such environments, the intent is that there is no perceptible variation in the torque to which each part or fastener is finally taken, thereby avoiding localized stressing of secured members.

In the use of torque limiting wrenches in mass production and assembly, it is also desirable that an inspector have a means for quickly assuring himself visually that each and every fastener has received the desired torque application, and that all of the fasteners have been identically tightened. Thus, a motion-responsive marking device has been typically incorporated into the torque limiting wrench to make this possible with ease.

The patents to Woods, U.S. Pat. Nos. 2,274,638; 2,897,704; and 3,016,773, all show torque limiting wrenches of the general type involved in the present tool, but lacking marking means of any sort. The patents to Lance, U.S. Pat. Nos. 3,523,471; 3,662,629; and 3,667,327, assigned to the assignee of the present invention, deal with part marking means incorporated in a torque wrench, but include marking mechanisms of a relatively complex and expensive nature, as compared with the simplicity, compactness and low production costs of the direct acting marker means of the present invention.

One of the problems with known torque wrench constructions is that there has been no convenient way of replacing the part engaging head assembly of the wrench with another head assembly of a different size. This, of course, is desirable when the wrench is used on parts or fasteners of various sizes. It is conventional in torque limiting wrenches of the type shown in the above-mentioned patents to directly connect the part engaging head assembly and associated marking mechanism to the pivotal torque applying arm of the wrench. When it becomes necessary to change one head assembly for another, a relatively complex uncoupling and recoupling procedure must be followed involving several parts, therby making the changeover time-consuming and expensive. Thus, there has been a need for a torque limiting and marking wrench having a quickly releasable part engaging head assembly that may be removed and replaced without affecting or involving the marking mechanism or torque applying arm of the wrench.

Another problem associated with known torque and marking wrench constructions is their inability to be changed in configuration when the working space available changes or when the position of the part or fastener changes. As the operator moves from one part to another, the position of the part may change and the working space available may change as well. Thus, another aspect of the present invention resides in providing a torque limiting and marking wrench that is adaptable to be configured in various positions depending upon the location and attitude of the part and the available work space.

SUMMARY OF THE INVENTION

The combined torque limiting and part marking wrench of the present invention is constructed with a few, extremely simple and reliable components. These, in general, comprise an elongated tubular torque applying handle having a torque transmitting arm pivotally mounted therein, a cylindrical housing mounted at one end to the torque applying handle, a replaceable part engaging head assembly releasably mounted to the other end of the cylindrical housing, and a part marking mechanism mounted within the cylindrical housing.

The torque transmitting arm within the handle shifts when the value of the torque exerted on a part engaged by the head assembly reaches a predetermined value thereby breaking the line of torque transmission to the part engaging head assembly and signaling to the operator that the desired torque has been reached and further effort should end. An on-off valve unit, associated with the torque applying handle, is actuated in response to the desired torque level being reached to operate the marking mechanism by which a mark is applied to the part simultaneously with the interruption of torque transmission.

The torque limiting and marking wrench of the present invention is adapted for being fitted with a plurality of head assemblies of various sizes and designs with each head assembly including a wrench head portion and a cylindrical shank portion that is releasably retained in the barrel end of the cylindrical housing. The construction of the wrench is such that an operator may quickly and conveniently replace any head assembly with another one of a different size or design by simply removing the head assembly from the barrel end of the cylindrical housing. This provides a considerable amount of versatility in using the wrench which has not heretofore been possible without a substantial amount of effort and the removal of more complicated parts.

Each head assembly further includes a bore which passes through the shank portion into the open part engaging area of the wrench head portion for permitting reciprocal movement of a striking pin from the marking mechanism. The striking pin is movable to provide a visual indicium that the part operated upon has been torqued to a desired amount. The rearward end of the striking pin is attached to the piston assembly that is slidably movable within the bore of the cylindrical housing in response to on-off fluid pressure against its rearward end. A fluid receiving chamber is formed behind the piston assembly for receiving pressurized fluid at the instant of reaching the "break" value of torque.

Thus, the striking pin is extended outwardly in response to fluid pressure acting upon the piston assembly for making a mark on the part at the instant the desired torque is reached. After the part has been marked, the striking pin is retracted within the cylindrical housing by a return spring.

A pneumatic on-off valve unit is mounted on the tubular torque applying handle of the wrench for actuating the piston assembly when the desired torque limit has been reached. The fluid receiving chamber behind the piston assembly is pneumatically pressurized by the value unit at the instant of reaching the "break" value of torque with the result being that the striking pin is driven in opposition to its return spring to place the desired mark on the part.

The cylindrical housing, which houses the marking assembly, is positionable at various attitudes relative to the torque applying handle to provide the optimum position for the head assembly relative to the part. This permits the operator considerable latitude in using the wrench, depending upon the location of the part and the space available. Further, since the head assembly is removable, a relatively straight head assembly may be replaced with one that is offset relative to the axis of the cylindrical housing thereby providing additional flexibility in using the wrench.

Thus, a feature of the present construction resides in the cylindrical housing that separates the torque applying handle from the head assmbly, since it is positionable at various locations depending on the position of the part to which torque is applied. The cylindrical housing also protectively covers the marking mechanism, including the striking pin, in a compact fashion thereby eliminating the more complicated arrangements of prior constructions. Further, the conveniently replaceable head assembly is easily coupled and uncoupled to the cylindrical housing for permitting considerable versatility in using the torque limiting and marking wrench.

Other advantages and meritorious features of the torque limiting and marking wrench of the present invention will be more fully understood from the following description of the invention, the appended claims, and the drawings, a brief description of which follows.

BRIEF DESCRIPTION OF DRAWINGS

FIG. 3 is a side elevational view of the torque limiting and marking wrench with the cylindrical housing offset 90° relative to the torque applying handle.

FIG. 4 is a cross-sectional view taken along line 4—4 in FIG. 3.

FIG. 5 is a top elevational view of the torque limiting and marking wrench with the cylindrical housing offset approximately 20° relative to the torque applying handle.

FIG. 6 is a side elevational view of the wrench illustrated in FIG. 5.

DETAILED DESCRIPTION OF THE INVENTION

Figures 1, 2:
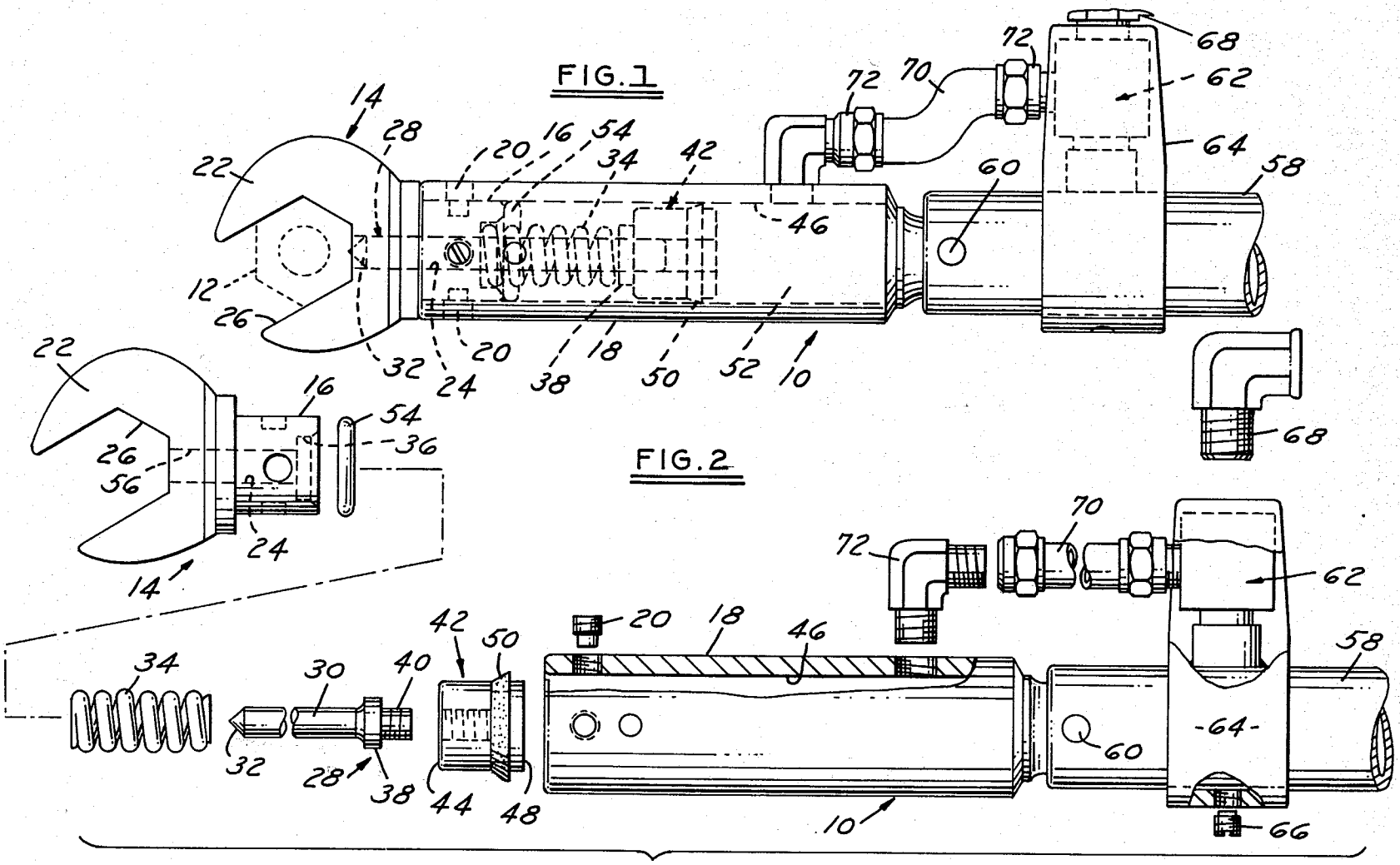
FIG. 1 is a top plan view of the torque limiting and marking wrench including a torque applying handle, a cylindrical housing for holding the marking mechanism, and a replaceable head assembly.
FIG. 2 is an assembly drawing illustrating the individual components of the torque limiting and marking wrench shown in FIG. 1.

The combined torque limiting and part marking wrench 10 of the present invention is constructed with a few, extremely simple and reliable components. These, in general, comprise an elongated tubular torque applying handle 58 having a torque transmitting arm (not shown) pivotally mounted therein, a cylindrical housing 18 mounted at one end to the torque applying handle 58, a replaceable part engaging head assembly 14 mounted to the other end of the cylindrical housing 18, and a part marking mechanism, generally 28, mounted within the cylindrical housing 18. An on-off valve unit 62, associated with the torque applying handle 58, is actuated in response to the desired torque level being reached to operate the marking mechanism whereby a mark is applied to the part 12 simultaneously with the interruption of torque transmission.

Wrench 10 is herein shown and described as being of a type adapted for the tightening and marking of a hex-headed part or fitting 12. However, it is to be understood that the tool is capable of use in the torsion-limited and mark-designated tightening of various other types of screw, bolt, stud or nut-like components.

The torque limiting and marking wrench 10 is adapted for being fitted with a plurality of head assemblies 14 of various sizes and designs as illustrated in FIGS. 1, 3, 5 and 8. Each head assembly 14 includes a cylindrical shank 16 that is releasably retained in the barrel end of cylindrical housing 18 by a number of peripherally positioned lock fasteners 20. While the head assemblies 14 are illustrated with open-ended wrench heads 22, it is contemplated that box end and socket-type wrench heads may also be used.

Thus, an operator may quickly and conveniently replace any head assembly 14 with another one of a different size or design by simply releasingfasteners 20 and pulling head assembly 14 from the barrel end of cylindrical housing 18. This provides a considerable amount of versatility in using wrench 10 which was not heretofore possible without a substantial amount of effort and the removal of more complicated parts.

Each head assembly 14 further includes a bore 24 which passes through shank piston 16 and into open fitting engaging area 26 of wrench head portion 22 for permitting reciprocal movement of striking pin 28. As will be described, striking pin 28 is movable to provide a permanent visual indicium that fitting 12, or any other part operated upon, has been torqued to a desired amount. If desired, striking pin 28 may be replaced by another marker of similar shape that leaves a less permanent mark on fitting 12.

Striking pin 28 includes an elongated, cylindrical portion 30 that ends in a part marking tip 32. A return spring 34 encircles pin portion 30 and is supported at one end within a recess 36 in cylindrical shank 16. The opposite end of return spring 34 engages one side of the annular abutment 38 adjacent the rearward end of striking pin 28. The rearward end 40 of striking pin 28 is threaded for attachment to piston assembly 42 whereby one end 44 of piston assembly 42 engages the other side of abutment 38.

Piston assembly 42 is slidably movable within the bore 46 of cylindrical housing 18 in response to on-off fluid pressure against its rearward end 48. Assembly 42 inclues a peripherally mounted seal 50 which sealingly engages cylindrical bore 46 such that a fluid receiving chamber 52 is formed behind piston assembly 42 for receiving pressurized fluid at the instant of reaching the "break" value of torque. An O-ring cushion 54 is provided at the other end of bore 46 to limit the forward reciprocal movement of piston assembly 42.

Thus, striking pin 28 is extended outwardly in response to fluid pressure acting on piston assembly 42 for making a mark on fitting 12 at the instant the desired torque is reached. After fitting 12 has been marked, striking pin 28 is retracted within housing 18 by return spring 34.

Referring to FIGS. 2, 3, 5 and 8, each of the illustrated configurations of wrench 10 include the same marking mechanism as just described, within the individual cylindrical housings 18. Two of the configurations of wrench 10, illustrated in FIGS. 2 and 5, include a bore 56 through wrench head portion 22 that is colinear with the shank portion bore 24 for permitting outward movement of striking pin 28 into the opening fitting engaging area 26 of wrench head portion 22. In the configuration of wrench 10 shown in FIGS. 3 and 4, a bore through wrench head portion 22 is unnecessary since the tip 32 of striking pin 28 marks the top of fitting 12. Finally, in the configuration of wrench 10 shown in FIGS. 7 and 8, the bore 56 through wrench head portion 22 is colinear with shank portion bore 24 but is inclined to the longitudinal axis of head portion 22.

The precision torque release and marking wrench 10 shown is generally similar in its torque limiting aspect of the wrench of Lance, U.S. Pat. No. 3,523,471, assigned to the assignee of the present invention, which disclosure is herein incorporated by reference. Wrench 10 includes an elongated, tubular handle 58 of cylindrical cross section with an elongated torque transmitting arm (not shown) pivotally mounted on a transverse axis within handle 58 by pin 60. Pin 60 permits the torque transmitting arm to shift laterally under a critical "break" torque of a maximum designed value. This is, of course, accompanied by the break of the line torque transmission to fitting 12, in a conventional manner. Specific structural details of the torque transmitting arm and its assembly constitute no part of the present invention, but an arrangement suitable for use in the present construction is illustrated in the aforementioned Lance U.S. Pat. No. 3,523,471.

A pneumatic on-off valve unit 62 is mounted on the tubular handle 58 of wrench 10 for actuating piston assembly 42 when the desired torque limit has been reached. The valve unit 62 is protectively covered by a guard member 64 that is fastened to handle 58 by fastener 66. Valve assembly 62 is connected to a conventional source of pressurized air (not shown) by air inlet fitting 68. Conduit 70, having opposed fittings 72, connects the discharge of valve assembly 62 to fluid chamber 52.

Cylindrical chamber 52 is pneumatically pressurized by valve unit 62 at the instant of reaching the "break" value of torque with resultant lateral swinging of the torque transmitting arm (not shown) in handle 58. This occurs when the torque on fitting 12 has reached the desired limit due to clockwise manipulating of wrench 10. Upon the torque reaching the "break" value, the torque transmitting arm and handle 58 swings about pivot 60, interrupting the line of torque transmission to fitting 12 and simultaneously depressing an operating button (not shown) within handle 58 for actuating valve unit 62. Valve unit 62 then pressurizes conduit 70 and fluid chamber 52, with the result that striking pin 28 is driven in opposition to return spring 34 to place the desired mark on fitting 12.

Figure 7:
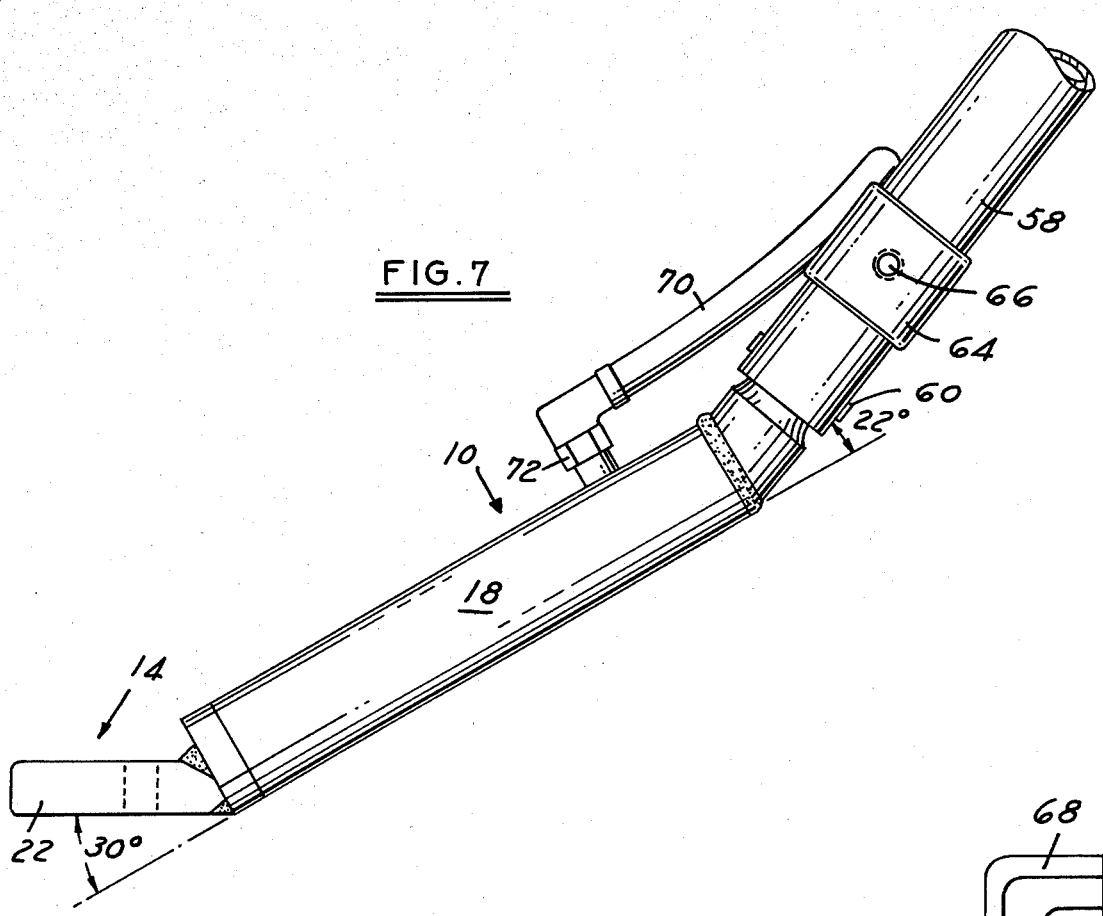
FIG. 7 is a side elevational view of the torque limiting and marking wrench with the cylindrical housing offset relative to the torque applying handle and the part engaging and of the head assembly offset relative to the cylindrical housing.
Figure 8:
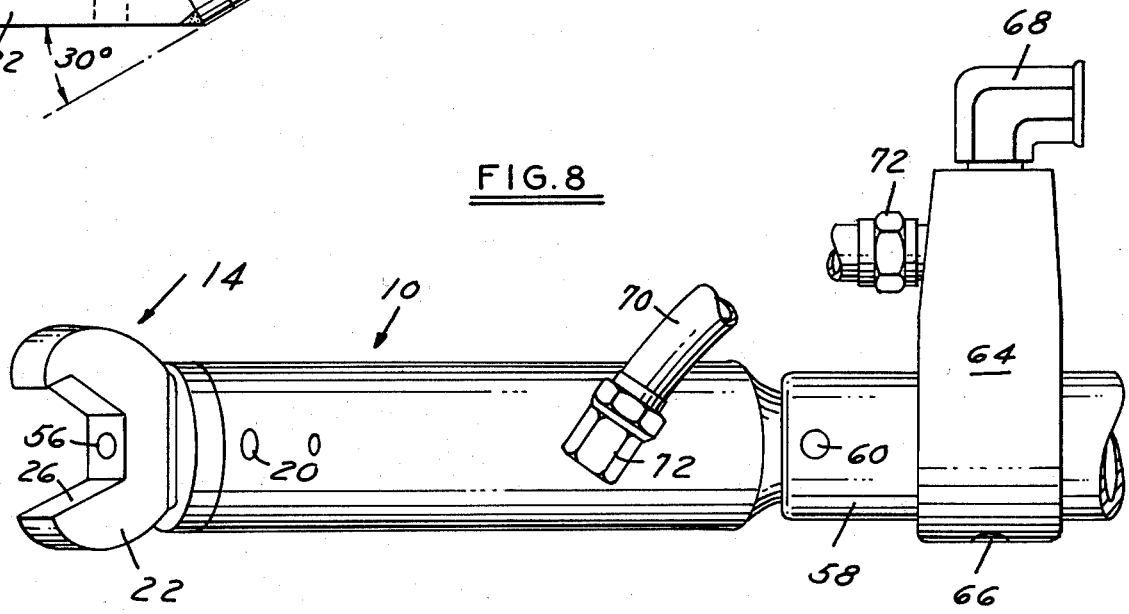
FIG. 8 is a top elevational view of the wrench illustrated in FIG. 7.

As illustrated in FIGS. 1, 3, 6 and 7, the cylindrical housing 18, which houses the marking assembly, is postionable at various attitudes relative to handle 58, to provide the optimum position for head assembly 14 relative to fitting 12. This permits the operator considerable latitude in using wrench 10, depending on the location of fitting 12 and the space available. In a tight space, for example, the operator may desire to use the configuration of wrench 10 that is illustrated in FIGS. 3 and 4 that includes a cylindrical housing 18 which is offset 90° relative to handle 58. If the axis of fitting 12 is inclined, the configuration of wrench 10 that is illustrated in FIGS. 5 and 6 may be more appropriate where cylindrical housing 18 is offset approximately 20° relative to handle 58. Further, since head assembly 14 is removable, a relatively straight head assembly may be replaced with one that is offset relative to the axis of cylindrical housing 18, as illustrated in FIGS. 7 and 8.

Thus, a feature of the present construction resides in the cylindrical housing 18 that separates the torque applying handle 58 from head assembly 14, since it is positionable at various locations depending upon the position of the part to which torque is applied. Housing 18 also protectively covers the marking mechanism, including striking pin 28, in a compact fashion, thereby eliminating the more complicated arrangements of prior constructions. Further, the conveniently replaceable head assembly 14 is easily coupled and uncoupled to housing 18 for permitting considerable versatility in using wrench 10.

It will be apparent to those skilled in the art that the foregoing disclosure is examplary in nature rather than limiting, the invention being limited only by the appended claims.

We claim:

1. A torque limiting and part marking wrench comprising an elongated tubular torque applying handle, an elongated generally cylindrical housing pivotally mounted at one end to said torque applying handle, a replaceable part engaging head assembly mounted to the other end of said housing, and a part marking mechanism mounted within said housing, said torque applying handle, cylindrical housing, head assembly and part marking mechanism being disposed along a common axis, means for releasably mounting said head assembly to said housing whereby said head assembly may be replaced with another head assembly of a different size or design, and said housing being positionable at various attitudes relative to said torque applying handle depending on the location of a part operated upon by the wrench and the available working space;

said head assembly including a wrench head portion having an open part engaging area and a generally cylindrical shank portion that is releasably retained within said other end of said housing by said mounting means;

said marking mechanism including a striking pin that passes through a bore in said head assembly shank portion for reciprocal movement, said striking pin being mounted to a piston assembly that is slidably movable within a bore in said housing, said striking pin being extended outwardly from said housing for marking a part in response to fluid pressure acting on said piston assembly and said striking pin being retracted within said housing by a return spring mounted between said head assembly shank portion and said piston assembly;

said housing including a fluid receiving chamber for receiving pressurized fluid from an on-off fluid valve unit mounted on said torque applying handle, said piston assembly being actuated in response to fluid pressure in said chamber from said valve unit when the torque on a part acted upon by said wrench has reached a predetermined value due to manipulation of said wrench.

2. The torque limiting and part marking wrench as defined in claim 1 wherein the longitudinal axis of said wrench head portion being offset relative to the longitudinal axis of said head assembly shank portion.

* * * * *